US005476761A

United States Patent [19]

Verbeeck et al.

[11] Patent Number: 5,476,761

[45] Date of Patent: Dec. 19, 1995

[54] PREPARATION METHOD OF REGULAR SILVER (HALIDE) BROMIDE OR SILVER BROMOIODIDE LIGHT-SENSITIVE EMULSIONS AND MATERIAL COMPRISING SAID EMULSIONS

[75] Inventors: Ann Verbeeck, Begijnendijk; Hubert Vandenabeele, Mortsel, both of Belgium

[73] Assignee: AGFA-Gevaert, N.V., Mortsel, Belgium

[21] Appl. No.: 304,473

[22] Filed: Sep. 12, 1994

[30] Foreign Application Priority Data

Sep. 16, 1993 [EP] European Pat. Off. ..... 93202679

[51] Int. Cl.[6] ..... G03C 1/015

[52] U.S. Cl. ..... 430/569; 430/567; 430/631; 430/545; 430/966

[58] Field of Search ..... 430/569, 567, 430/631, 966, 545

[56] References Cited

FOREIGN PATENT DOCUMENTS 0392092 10/1990 European Pat. Off. .
0517961 12/1992 European Pat. Off. .
0528476 2/1993 European Pat. Off. .

*Primary Examiner*—Charles L. Bowers, Jr.
*Assistant Examiner*—Mark F. Huff
*Attorney, Agent, or Firm*—Breiner & Breiner

[57] ABSTRACT

A method is disclosed to prepare a light-sensitive regular silver bromide or silver bromoiodide emulsion, wherein said method comprises the following the steps:

precipitating silver bromide or silver bromoiodide by means of the double-jet or triple-jet technique in colloidal silica having a particle size from 0.003 μm to 0.30 μm as a protective colloid in the absence of any polymeric compound(s) comprising gelatin or its derivatives capable of forming hydrogen bridges with colloidal silica, except for polythioether compounds, but always in the presence of an onium compound, except for an ammonium compound, wherein the ratio by weight of said colloidal silica to the said onium compound(s) is between 3 and 30, and, optionally, in the presence of a crystal growth modifier, controlling the nucleation and growth steps by means of variable flow rate(s) of the aqueous solutions of silver nitrate and halide salts and/or by means of constant pAg-values during the said steps in the vessel in order to determine the number of nuclei quantitatively in the nucleation step and to avoid renucleation in the growth step, desalting the reaction medium and redispersing the silver halide, chemically ripening the silver halide crystals and adjusting the ratio by weight of the colloidal silica sol to the amount of silver halide, expressed as the equivalent amount of silver nitrate to a value of at least 0.03 at every moment throughout the precipitation stage.

9 Claims, No Drawings

PREPARATION METHOD OF REGULAR SILVER (HALIDE) BROMIDE OR SILVER BROMOIODIDE LIGHT-SENSITIVE EMULSIONS AND MATERIAL COMPRISING SAID EMULSIONS

FIELD OF THE INVENTION

The present invention relates to a preparation method of regular silver bromide and bromoiodide light-sensitive emulsion crystals and to a light-sensitive photographic material wherein the corresponding emulsions are used.

BACKGROUND OF THE INVENTION

The effects of various precipitation conditions on the formation of stable AgBr crystals have been studied in a balanced double-jet precipitation by Leubner, Wey and Jagannathan and have been disclosed in e.g. Phot. Sc. Eng., Vol. 21 (1977), p. 14, Vol. 23 (1977), p. 248–252 and Vol. 24 (1980), p. 268–272; in J. Imaging Sci., Vol. 34(1990), p. 202–206; in J. Cryst. Growth, Vol. 51 (1981), p. 601–606; and in "Proceedings ICPS Int. Congress of Phot. Science 1986": Progress in Basic Principles of Imaging Systems, p. 60.

From these documents the number of nuclei generated during the nucleation stage can be calculated in a semi-emperical way, provided that the values in the reaction vessel of pAg, temperature, concentration of silver complexing reagents and flow rate of the silver and halide containing solutions are controlled during the said stage.

In these well-defined circumstances the crystal size distribution at the end of the precipitation stage is perfectly predictable but an important condition is that during the process of precipitation, proceeding in an aqueous solution of gelatin as protective colloid, two principal stages can be distinctly provided, namely a nucleation stage and a growth stage.

During the nucleation stage no agglomeration may occur so that the number of nuclei formed stays predictable, whereas during the growth stage further control is required in such a way that no renucleation can appear.

Although playing a crucial role in both stages of the precipitation, the role of the protective colloid is sometimes underestimated: said protective colloid has to be considered, not only as a dispersing medium for the fully grown crystals, but particularly as a stabilizing medium for the nuclei. So aggregation of nuclei can be prevented and during the further crystal growth stage the interaction of the protective colloid with the growing crystal surface moderates the crystal growth rate, thereby preventing renucleation as has been suggested by Antoniades and Wey in J. Imaging Sci. and Technol. Vol. 36 (1992), p. 517–524.

From the considerations given above it can be concluded that the protective colloid is determining to a large extent the average crystal diameter and the homogeneity of the crystal size distribution and is offering the possibility to stear the crystal size and the crystal size distribution.

Moreover the protective colloid is also determining the physical properties of the coated film material wherein the silver halide emulsions are incorporated. Properties as e.g. dimensional stability, scratchability, curl, pressure sensitivity and sludge formation after processing are highly dependant on the choice of the protective colloid. A phenomenon like pressure sensitivity may appear as pressure marks, pressure sensitization or desensitization, wherein both the protective colloid and the coated matrix have to dissipate the energy developed by the pressure force when the coated layer is dried and deformed afterwards in packaging, before and after exposure and by processing. As adsorption of the protective colloid at the crystal surface occurs development characteristics are further influenced by the said protective colloid.

As has been set forth in EP-Application No. 528 476 a method of preparing a silver halide light-sensitive photographic material incorporating layers of silver halide precipitated in colloidal silica serving as a protective colloid is given. In this document the silver halides are prepared in colloidal silica, leading to emulsion crystals that are stable at the end of the precipitation, but without having a predictable mean crystal diameter and crystal size distribution. As a consequence problems arise by scaling-up of the emulsions prepared as described in the examples of the said EP-Application resulting in unpredictable grain sizes and in a broadening of the size distribution of the crystals at larger scale. Moreover the concentration of the silver halide crystals in the reaction vessel at the end of the precipitation is so low that ultrafiltration is not applicable.

OBJECTS OF THE INVENTION

It is an object of the present invention to provide a method for preparing regular silver bromide and bromoiodide light-sensitive emulsion crystals and the corresponding regular emulsions, in a reproducible and perfectly predictable way, in small laboratory vessels as well as in large vessel in production units.

It is a further object to obtain reproducible sensitometric characteristics from the exposed and processed photographic material wherein the said regular emulsions have been coated.

It is especially contemplated for the said photographic material to provide a high and reproducible sensitivity and gradation without dye stain and/or pressure marks in rapid processing applications.

Other objects will become apparent from the description hereinafter.

SUMMARY OF THE INVENTION

According to this invention a method is provided to prepare a light-sensitive regular silver bromide or bromiodide emulsion, containing crystals with a predictable size distribution and wherein said method comprises the following the steps:

precipitating silver bromide or silver bromoiodide [halide] by means of the double-jet or triple-jet technique in colloidal silica having a particle size from 0.003 μm to 0.30 μm as a protective colloid in the absence of any polymeric compound(s) comprising gelatin or its derivatives capable of forming hydrogen bridges with colloidal silica, except for polythioether compounds, but always in the presence of an onium compound, except for an ammonium compound, wherein the ratio by weight of said colloidal silica to the said onium compound(s) is between 3 and 30, and, optionally, in the presence of a crystal growth modifier, controlling the nucleation and growth steps by means of variable flow rate(s) of the aqueous solutions of silver nitrate and halide salts and/or by means of constant pAg-values during the said steps in the vessel in order to determine the number of nuclei quantitatively in the nucleation step and to avoid renucleation in the growth step, desalting the reaction medium and redispersing the silver halide, chemically ripening the silver halide crystals and adjusting the ratio by weight of the colloidal silica sol to the amount of silver halide, expressed as the equivalent amount of silver nitrate to a value of at least 0.03 at every moment throughout the precipitation stage.

Further according to this invention a method is provided comprising in addition to the above steps the further steps of adding to the redispersed and chemically ripened emulsion an amount of hydrogen-bridge forming polymer and/or colloidal silica so that the ratio of hydrogen bridge-forming polymer to silver halide expressed as the equivalent amount of silver nitrate is comprised between 0.05 and 0.40 and the ratio of silica to silver halide expressed as silver nitrate is comprised between 0.03 and 0.30.

The invention also provides a silver halide light-sensitive photographic material having a support and, provided thereon, at least one hydrophilic colloid layer including light-sensitive silver bromide or bromoiodide emulsion crystals covered with silica particles.

DETAILED DESCRIPTION OF THE INVENTION

The light-sensitive silver bromide and silver bromoiodide emulsions prepared according to this invention are characterized by a regular lattice structure having faces covered with silica particles as silica is used as a protective colloid.

The said regular lattice structures are characterized by the presence of repetitive elements having a radial symmetry. Well-known are e.g. cubic, octahedral and cubo-octahedral structures of silver halide crystals that are frequently met in photographic materials.

For the precipitation process according to the invention suitable silica sols are commercially available such as the "Syton" silica sols (a trademarked product of Monsanto Inorganic Chemicals Div.), the "Ludex" silica sols (a trademarked product of du Pont de Nemours & Co., Inc.), the "Nalco" and "Nalcoag" silica sols (trademarked products of Nalco Chemical Co), the "Snowtex" silica sols of Nissan Kagaku K.K. and the "Kieselsol, Types 100, 200, 300, 500 and 600" (trademarked products of Bayer AG). Particle sizes of the silica sol particles are in the range from 3 nm to 30 μm. The smaller particles in the range from 3 nm to 0.3 μm are preferred as the coverage degree that can be achieved will be higher and as the protective action of the colloidal silica will be more effective.

During the precipitation of silver halide crystals in colloidal silica as a protective colloid onium compounds as co-stabilizers for the colloidal silica are required as has been disclosed in U.S. Ser. No. 07/698,921 filed May 13, 1991, is incorporated herein by reference.

Further during the precipitation stage of the regular silver bromide and bromoiodide crystals the amount of silica sol and of the onium compound(s), should be optimized so as to avoid uncontrolled formation and growth of aggregates of AgBr or AgBr(I). This phenomenon is well-known and is called "clumping".

According to this invention it has been found that before the start of the precipitation of silver halide crystals in the presence of colloidal silica, aggregates should be present of colloidal silica together with onium co-stabilizing compounds, wherein the said aggregates should act analogously as a protective "polymer" for the silver halide nuclei formed, just as e.g. gelatin. Especially at lower pH values, e.g. at a pH value of 3.0, onium compounds and silica sol particles are forming the required aggregates. This is offering a further advantage in that stable emulsion crystals can be formed at relatively low pH values, e.g. at pH values below 4.0, whereas this is an unfavourable pH range, especially for HIEP gelatins.

According to this invention a method has thus been found of preparing a light-sensitive regular silver bromide or a silver bromoiodide emulsion by the steps of precipitating the corresponding silver halide grains by means of the double- or triple-jet technique in colloidal silica as a protective colloid in the absence of any polymeric compound(s) capable of forming hydrogen bridges with colloidal silica, but in the presence of an onium compound. The formation of silver halide nuclei should start in a vessel wherein the ratio by weight of the said colloidal silica to the said onium compound(s) is between 3 and 400, and more preferably between 3 and 30, wherein the average silica sol particle size is between 0.003 an 30 μm, more preferably between 0.003 and 0.30 μm, and wherein the ratio by weight of the colloidal silica sol to the amount of silver halide, expressed as the equivalent amount of silver nitrate is at least 0.03 at every moment throughout the precipitation step. It should be noted that these three conditions are of crucial interest in order to reach the objects of this invention and that they should be fullfilled simultaneously.

Controlling at least one of the parameters like the temperature, the flow rate(s) of silver and halide containing solutions, the pAg-value and the amount of crystal growth modifier, if present, is required so that the number of nuclei formed during the nucleation step becomes predictable and in order to avoid renucleation during the growth step. In a further stage after the end of the precipitation, desalting and redispersing of the silver halide emulsion, followed by chemically ripening provides an emulsion that can be prepared for coating in light-sensitive photographic layers of silver halide photographic materials.

Before starting the precipitation of silver halide emulsion crystals according to this invention an easy way to determine the presence of aggregates of the colloidal silica and the onium compound(s) in the reaction vessel makes use of the measurement of the "turbidity" in the reaction vessel before the start of the precipitation reaction of silver and halide ions. The said "turbidity" can be defined as the "cloudy" or "hazy" appearance in a naturally clear liquid caused by a suspension of colloidal liquid droplets or fine solids". The reduction of the transparancy to visible radiation can be established qualitatively or measured quantitatively. A quantitative measure for the said "turbidity" is the so-called "turbidity coefficient". Said coefficient is a factor in the equation of the law of light absorption which describes the extinction of the incident light beam.

Changes in the transparancy of an aqueous solution of silica sol and an onium compound are indicative for the presence or the absence of an ideal "network-structure" for the silica particles that should act as protective colloidal particles for the silver halide crystals formed. So it has been found experimentally that the ratio by weight of the amount of silica sol versus the onium compounds has to be lower than 400. Values between 3 and 400 are preferred and still more preferred are values between 3 and 30, provided that the particle size of the silica sol is from 3 nm to about 0.30 μm as has been set forth hereinbefore. After mixing both compounds in the reaction vessel and once the critical value has been attained a turbid solution appears in the reaction vessel, indicating that aggregates are present. As has already explained the said aggregates offer the advantage that no aggregation or clumping of silver bromide or silver bromoiodide nuclei appears so that the number of nuclei remains reproducible, not only from batch to batch, but also by scaling up procedures.

So it has been experimentally observed that very fine silica particles of e.g. 3 nm require high amounts of onium compounds so that the ratio by weight of silica to onium compounds has a lower value, e.g. 30. Otherwise coarser silica particles of e.g. 30 μm require lower amounts of onium compounds and correspondingly higher ratios by weight of silica to the said onium compounds of about e.g. 300.

During the growth stage following the nucleation step the growth is substantially diffusion controlled and as a consequence the crystal size at the end of the precipitation is perfectly predictable.

Moreover in these well-described precipitation circumstances the regular silver bromide or silver bromoiodide emulsion crystals are monodisperse to a variation coefficient of less than 0.30. Further additions of silica to the precipitation vessel may be necessary during the further precipitation stages, e.g. at the end of the nucleation stage, before growing the nuclei or even during the growth step. Additional amounts of silica and, if necessary onium compound(s), may be added to the reaction vessel in one or more portions or continously in a triple-jet precipitation system. Especially preferred are additions during so called Ostwald ripening stages, e.g. before the flow rate of the silver and/or halide solutions is increased in a double-jet precipitation system.

As onium compounds acting as effective stabilisers, provided that according to this invention an appropriate amount is added to the reaction vessel versus the amount of silica present, the following compounds represented by the following general formulae can be used:

wherein $X^-$ represents an anion and $A^+$ represents an onium ion selected from any of the following general formulae:

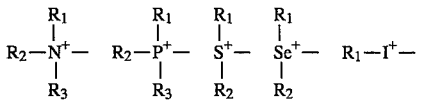

wherein:

each of $R_1$ and $R_3$ (same or different) represents hydrogen, an alkylgroup, a substituted alkyl group, a cycloalkyl group, an aryl group or a substituted aryl group, $R_2$ represents any of the said groups represented by $R_1$ and $R_3$ or the atoms necessary to close a heterocyclic nucleus with either $R_1$ or $R_3$, the said onium ion being linked 1) to a polymer chain, or 2) via a bivalent organic linking group e.g., —O—, —S—, —$SO_2$, . . . to any other of such onium structure, or 3) directly to any of the groups represented by $R_1$.

Suitable examples of onium compounds are disclosed in U.S. Pat. No. 3,017,270. In said specification suitable examples are mentioned of trialkyl sulfonium salts, polysulfonium salts, tetraalkyl quaternary ammonium salts, quaternary ammonium salts in which the quaternary nitrogen atom is a part of a ring system, cationic polyalkylene oxide salts including e.g. quaternary ammonium and phosphonium and bis-quaternary salts.

Onium salt polymers whereby the onium group may be e.g. an ammonium, phosphonium or sulphonium group, are disclosed in U.S. Pat. No. 4,525,446.

Polymers can be added as substitutes for or addition to the onium compounds cited above. Typical examples of suitable polymers are polythioethers. Although not limited thereto suitable polythioethers according to the general formula (I) can be used, the average molecular weight varying from about 150 to 450.

$$-(-(CH_2)_2-S-(CH_2)_2-O-(CH_2)_2-O-(CH_2)_2-O-)_n-\quad(I)$$

It is evident that the polymers disclosed in EP-A 517 961 are excluded as they cause flocculation of silica emulsions if added in low amounts as set forth in said EP-A.

The silver halide particles of the photographic emulsions according to the present invention have a regular crystalline form, e.g. cubic or octahedral or a cubo-octahedral transition form. The silver halide grains may also have a multilayered grain structure provided that at the end of the preparation a regular crystal habit is obtained.

The crystals may be doped with whatever a dope, as e.g. $Rh^{3+}$, $Ir^{4+}$, $Cd^{2+}$, $Zn^{2+}$, $Pb^{2+}$.

During precipitation grain growth restrainers or accelerators may be added to obtain crystals with a preferred average crystal size between 0.05 and 2.5 μm. Examples of grain growth accelerators are compounds carrying e.g. a thioether function. Although there is no need for grain growth restrainers to prepare ultrafine silver halide crystals it may be useful to add one e.g. when the temperature is high in the reaction vessel. When preparing ultra fine grains in the presence of growth restrainers, as e.g. phenylmercaptotetrazoles, it should be noted that these restrainers strongly adsorb to the silver halide crystal surface and that it is very difficult, if not impossible to remove them by washing procedures so that their influence on photographic properties persists after coating. Therefore this is preferably avoided. Ultra fine emulsions can act as seed crystals in preparation techniques, making use of Ostwald ripening or recrystallisation steps.

It is important to avoid renucleation during the growth step of the nuclei formed in the nucleation step by controlling the preferred increasing rate of addition of the silver nitrate and the halide salts to make the distribution of the silver halide crystals formed predictable.

Silver bromide or bromoiodide nuclei can also be formed in a separate vessel and added to the reaction vessel wherein the growth step is performed. In the said reaction vessel additional amounts of silica and onium compound may be present.

According to this invention it is possible to add the silver and bromide or bromoiodide salt solutions in a concentrated vessel, provided that the concentration of the silica and of onium compound creating the "protective network" for the formed silver bromide or bromoiodide crystals is adapted thereto.

So opposite to the examples given in EP-A 528 476 concentrations going from 0.5 to 4 molar of silver halide and more preferably from 1 to 3 molar are attainable in the reaction vessel at the end of the precipitation.

Another advantage related thereto is that the coagulation washing method, followed by redispersion as described for silica sol emulsions in EP-A 517 961 is not required. In a preferred embodiment according to this invention desalting of the emulsion is performed by ultrafiltration. Especially this feature is illustrative for the protective action of the silica sol in the presence of an onium compound, thereby acting as a "network-stabilizing" agent: it proves that the crystal lattice is protected very efficiently and able to resist quite strong mechanical forces thereupon. Ultrafiltration can thus be applied without complications with respect to fog level or pressure sensitivity after processing.

The light-sensitive silver halide emulsion prepared in accordance with the present invention is, after redispersion, a so-called primitive emulsion. However, the light-sensitive silver bromide or bromoiodide emulsion prepared according to the present invention can be chemically sensitized as described i.a. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodanines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used. A mixture can also be made of two or more separately precipitated emulsions being chemically sensitized before mixing them.

According to this invention chemical ripening is performed before, during or after spectral sensitization. Spectral sensitization of the light-sensitive silver bromide or bromoiodide crystals can be performed with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds.

As the starting point after precipitation of the silver bromide or bromoiodide is a gelatin to silver nitrate ratio of zero, the ratio by weight of gelatin over silver nitrate is adjusted by adding an adapted amount of gelatin at the stage of or after redispersing the desalted emulsion. The ratio of silica to silver nitrate is determined at the stage of precipitation and/or by further addition of silica at the redispersion stage or later. According to this invention the emulsion is made ready for coating by addition to the emulsion of an amount of hydrogen-bridge forming polymer, e.g. gelatin, and/or silica in such an amount that the ratio of hydrogen bridge-forming polymer to silver halide expressed as silver nitrate is comprised between 0.05 and 0.40 and more preferably between 0.15 and 0.30. Otherwise the preferred ratio of silica to silver halide expressed as silver nitrate is comprised between 0.03 and 0.3 and more preferably between 0.05 and 0.15. The lower values described in this disclosure if compared to those in EP-A 528 476 are applicable thanks to the improved precipitation conditions resulting in better silica protected silver bromide or bromoiodide emulsions.

Before coating to the silver bromide or bromoiodide emulsion prepared in accordance with the present invention may be added compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75–39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are metal salts such as e.g. mercury or cadmium salts and the compounds described in Research Disclosure No. 17643 (1978), Chaptre VI.

The fog-inhibiting agents or stabilizers can be added to the silver bromide or bromoiodide emulsion prior to, during, or after the chemical ripening thereof and mixtures of two or more of these compounds can be used.

The silver bromide or bromoiodide emulsions prepared in accordance with the present invention can be used to form one or more silver halide emulsion layers coated on a support to form a photographic silver halide element according to well known techniques.

Separately formed two or more different silver bromide and/or silver bromoiodide emulsions may be mixed for use in the coated layers of photographic materials according to the present invention.

The photographic element of the present invention may comprise various kinds of surface-active agents in the photographic emulsion layer or in at least one other hydrophilic colloid layer. Suitable surface-active agents include nonionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805-4,038,075-4,292,400.

The photographic element of the present invention may further comprise various other additives such as e.g. compounds improving the dimensional stability of the photographic element, UV-absorbers, spacing agents, hardeners, and plasticizers as described below.

The layers of the photographic element, especially when the binder therein used is gelatin, can be hardened with appropriate hardening agents such as those of the epoxide type, those of the ethylenimine type, those of the vinylsulfone type e.g. 1,3-vinyl-sulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts.

The emulsion may be coated on any suitable substrate such as, preferably, a thermoplastic resin e.g. polyethyelenterephtalate or a polyethylene coated paper support.

Suitable additives for improving the dimensional stability of the photographic element may be added, i.a. dispersions of a water-soluble or hardly soluble synthetic polymer e.g. polymers of alkyl (meth)acrylates, alkoxy(meth)acrylates, glycidyl (meth) acrylates, (meth) acrylamides, vinyl esters, acrylonitriles, olefins, and styrenes, or copolymers of the above with acrylic acids, methacrylic acids, α-β-unsaturated dicarboxylic acids, hydroxyalkyl (meth) acrylates, sulphoalkyl (meth)acrylates, and styrene sulphonic acids.

Plasticizers suitable for incorporation in the emulsions according to the present invention are e.g. glycol, glycerine, or the latexes of neutral film forming polymers including polyvinylacetate, acrylates and methacrylates of lower alkanols, e.g. polyethylacrylate and polybutylmethacrylate.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 μm and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Embedded in a photographic material the regular silver bromide or silver bromoiodide crystals prepared according to this invention are surrounded by colloidal silica, serving as an extremely useful protective colloid. An especially advantageous effect resulting therefrom is the better resistance of the coated material to pressure phenomena. Emulsion layers in accordance with the present invention, and more particularly thin emulsion layers, are showing remarkable improvements concerning both resistance to stress and rapid processability compared to conventional emulsions prepared in gelatinous medium. As the ratio by weight of gelatin to silver bromide or silver bromoiodide, expressed as the equivalent amount of silver nitrate, decreases more pronounced pressure marks can be expected. Nevertheless as a result of the protective action of the adsorbed silica to the silver halide crystal surface much less pressure sensitivity appears.

The photographic silver bromide or silver bromoidide emulsions can be used in various types of photographic elements such as i.a. in photographic elements for so-called amateur and professional photography, for graphic arts, diffusion transfer reversal photographic elements, low-speed and high-speed photographic elements, X-ray materials, micrografic materials etc.

In a preferred embodiment the photographic silver bromide or silver bromoiodide emulsions are used in X-ray materials.

In the precipitation conditions mentioned hereinbefore it is thus possible, not only to get very homogenous crystal size distributions, but also perfectly predictable average crystal sizes, and as a consequence a perfect scaling up becomes available. In addition thereto a clearly improved fog level and a decreased pressure sensitivity for the coated emulsions in various processing conditions can be attained.

The following examples illustrate the invention. All percentages are percentages by weight unless otherwise stated.

EXAMPLES

Example 1

(invention)

A photographic silver iodobromide emulsion containing 1.0 mole % of silver iodide was prepared by the double jet method in a vessel containing 572 ml of demineralized water, 324 ml of 15% silica sol 'Kieselsol 500' (trademarked product of Bayer AG),×g of 3,6-dithio-1,8-octanediol as a grain growth accelerator, wherein x was varied from a value of 0 for emulsion No. 1 to a value of 0.3 for emulsion No. 7 and 103 ml of a 5% solution of co-stabilizing phosphonium compound $(Phen)_3—P^+—CH_2—CH_2OH.Cl^-$, wherein Phen represents phenyl. The temperature was stabilized at 50° C. and the pH value was adjusted to a value of 3.0.

During 5 minutes, a silver nitrate solution (2.94M) was added to the reaction vessel at a constant flow rate of 8 ml/min. Simultaneously a mixed halide solution containing 465 ml of KBr and 20 ml of KI having the same molarity of the $AgNO_3$ solution was added to the said vessel at a flow rate of the mixed halide salt solution in order to adjust the pAg at +50 mV vs. S.C.E., throughout this precipitation stage. The mixing of both solutions took place with central stirring means at 400 rpm. The pAg value was measured with a silver electrode having the temperature of the reaction vessel and a calomel reference electrode at 25° C. outside the said vessel, and wherein the connection with the reaction vessel was made with a salt bridge. After the said 5 minutes the flow rate of the silver nitrate solution was increased continously up to 30 ml/min during 23.4 minutes. The mixed halide solution was further added at an addition rate so as to maintain the same constant pAg value. During the following growth step of the silver bromide shell the flow rate of the silver salt solution was increased from 20 to 30 ml/min in a time interval of 10 minutes. At that maximum flow rate the precipitation was ended 8.8 minutes later. During the said growth step a solution of 2.94M KBr was added and the pAg value was further maintained at +50 mV.

The emulsions obtained were of a cubic crystal habit and of an average grain size μ (expressed in μm) as summarized in Table I, depending on the amount of grain growth accelerator (GGA; expressed in g) present. The homogeneity of the silver halide grain distribution is expressed in the table by the value of ν, defined as the ratio between the calculated standard deviation and the value of the mean crystal diameter μ, calculated from the volume of each grain, wherein for each grain the form of a sphere was chosen schematically.

TABLE I

| GGA | 0 | 0.05 | 0.10 | 0.15 | 0.20 | 0.25 | 0.30 |
|---|---|---|---|---|---|---|---|
| μ | 0.13 | 0.15 | 0.18 | 0.26 | 0.33 | 0.40 | 0.47 |
| ν | 0.24 | 0.22 | 0.21 | 0.15 | 0.25 | 0.15 | 0.21 |

From Table I it can be concluded that each of the crystal size distributions can be considered to be fairly homogenous.

Example 2

(control)

A photographic silver iodobromide emulsion containing 1.0 mole % of silver iodide was prepared by the double jet method in a vessel containing 374 ml of demineralized water, 75 ml of 15% silica sol 'Kieselsol 500' (trademarked product of Bayer AG) and 51.6 ml of the 5% co-stabilizing phosphonium compound as in example 1. The temperature was stabilized at 20° C. and the pH value was adjusted to a value of 3.0.

During 5 minutes, a silver nitrate solution (2.94M) was simultaneously added to a the reaction vessel, at a constant flow rate of 40 ml/min, together with a mixed halide solution containing 495 ml of KBr and 5 ml of KI having the same molarity of the $AgNO_3$ solution. The flow rate of the mixed halide salt solution was varied in such a way as to adjust the pAg at +25 mV vs. S.C.E., a value that was held constant during the whole precipitation stage. The reaction vessel was provided with central stirring means, rotating at 400 rpm. After 5 minutes the flow rate of the silver nitrate solution was increased up to 55 ml/min during 6.3 minutes and the pAg value was held constant at the same value by an adapted flow rate of the simultaneously added said mixed halide solution.

The obtained emulsion was of a cubic crystal habit and had an average grain size μ of 0.20 μm. The crystal size distribution was very heterogeneous: ν=0.58, due to the presence in the reaction vessel of too low an amount of silica and/or too low a ratio of silica:co-stabilizer.

Example 3

The silver halide was precipitated just as in example 1, except for the presence of 324 ml of 15% silica sol 'Kieselsol 500' (trademarked product of Bayer AG), 0.325 g of 3,6-dithio-1,8-octanediol and 51.6 ml of a 5% solution of the said co-stabilizing phosphonium compound. An average crystal diameter of 0.62 μm was obtained for the cubic silver halide crystals. The emulsion was washed by ultrafiltration and a small amount of gelatin was added to obtain a weight ratio of gelatin to silver halide (expressed as silver nitrate) of 0.15. Before the emulsion was cooled the pH was brought to a value of 6.5. The obtained silver halide crystal contained an amount of silver bromoiodide emulsion corresponding to approximately 180 g of silver nitrate per kg.

As a comparative emulsion with the same halide composition the silver halide crystals were prepared by a conventional double jet method in a vessel containing 40 g of phthaloyl gelatin. The ammoniacal silver nitrate solution as well as the emulsion vessel, containing the halide salts were held at 42° C. At a constant rate of 300 ml per minute the precipitation time was ended after 10 minutes and followed by a physical ripening time of 40 minutes. After that time an additional amount of 20 g of gelatin was added. The obtained emulsion was of an average grain size of 0.62 μm and contained approximately 90 g of silver nitrate per kg of the dispersion after addition of 3 moles of silver nitrate.

After addition of sulphuric acid to a pH value of 3.5 stirring was stopped and after sedimentation the supernatant liquid was removed. The washing procedure was started after a scrape-rudder was installed and after addition of polystyrene sulphonic acid to get a quantitative flocculate without silver losses.

During the redispersion of the emulsion 150 g of gelatin were added so that the weight ratio of gelatin to silver halide (expressed as silver nitrate) was 0.42, the emulsion containing an amount of silver bromoiodide equivalent with 190 g of silver nitrate per kg.

Both emulsions were chemically ripened with sulphur and gold at 47° C. for 4 hours to get an optimized relation between fog and sensitivity and were stabilized with 4-hydroxy-6-methyl-1,3,3a-tetrazaindene before coating on one side of a polyester support of 175 μm thickness. The emulsion layers were overcoated with a protective layer. Amounts of coating solutions were the same in Both cases in the emulsion layer as well as in the protective layer. The following ingredients were added per mole of silver halide before coating:

362.5 mg of anhydro-5,5'-dichloro-3,3'-bis(n.sulfobutyl)-9-ethyloxacarbo-cyanine hydroxide as spectral sensitizer, 785 mg of 4-hydroxy-6-methyl-1,3,3a,7-tetraazaindene as antifogging agent and stabilizer, 39 mg of phloroglucin as hardening accelerator 2.68 g of resorcin as hardening agent Demineralized water was added so as to reach a concentration corresponding to 170 g of silver nitrate pro liter of coating solution.

A protective coating composition was prepared containing per liter the following ingredients in demineralized water:

35.4 g of an inert gelatin 37 g of silica sol with silica particles having an average diameter of from 7 to 10 nm 20 g of an aqueous dispersion of matting agent with a particle size diameter of 2 μm comprising 3.2% of polymethylmethacrylate and 10% of gelatin 225 mg of chromium acetate as a hardening agent 300 mg of ammoniumperfluoro-octanoate (FC143, trade name product from 3M) and 750 mg of N-polyoxyethylene-N-ethyl-perfluoro-octanesulfonamide (FC170C, trade name product from 3M) as surfactants 1500 mg of phenol as preserving agent 1000 mg of Mobilcer Q from MOBIL OIL as a lubricant Formaldehyd was added as a hardening agent.

As a result differences in coating amounts of silver halide crystals, expressed as the equivalent amount of silver nitrate and of gelatin in the emulsion layer were i.e. 4.8 g/m$^2$ of silver nitrate for the comparative example and for the silica emulsion, gelatin 1.92 and 1.44 g/m$^2$ respectively, so that the ratios of gelatin to silver nitrate for both emulsions were approximately 0.4 (for the comparative example) and 0.3 (for the example corresponding to the invention) respectively. After coating of the protective antistress layer, the total amount of gelatin coated was 3.02 and 2.54 g/m$^2$ respectively.

Due to the high amount of hardening agent the said agent should be added to the coating composition of the protective topcoat layer just before coating so as to have a comparative water absorption.

On the opposite side a conventional antihalation backing layer was coated.

After coating and drying, the coated materials were exposed with with green light of 540 nm during 0.1 seconds using a continuous wedge and were processed during the 90 seconds dry-to-dry cycle with conventional hardening X-ray chemicals (developer G138, trade name product of Agfa-Gevaert; fixer G 334, trade name product of Agfa-Gevaert) in a first experiment; in a concentrated hardener-free developer, the composition of which is given hereinafter, in a second experiment.

| Composition of the developer: | |
|---|---|
| -concentrated part: | |
| water | 200 ml |
| potassium bromide | 6 grams |
| potassium sulphite (65% solution) | 247 grams |
| ethylenediaminetetraacetic acid, sodium salt, trihydrate | 9.6 grams |
| hydroquinone | 112 grams |
| 5-methylbenzotriazole | 0.076 grams |
| 1-phenyl-5-mercaptotetrazole | 0.040 grams |
| sodiumtetraborate (decahydrate) | 18 grams |
| potassium carbonate | 50 grams |
| potassium hydroxide | 57 grams |
| diethylene glycol | 100 grams |
| potassium iodide | 0.088 grams |
| 4-hydroxymethyl-4methyl-1phenyl-3-pyrazolidinone: | 12 grams |
| Water to make 1 liter | |
| pH adjusted to 11.15 at 25° C. with potassium hydroxide. | |

For initiation of the processing one part of the concentrated developer was mixed with 3 parts of water. No starter was added. The pH of this mixture was 10.30 at 25° C.

In Table II sensitometric data obtained in the two processing cycles (P1 and P2) as well as figures for the qualitative evaluation of pressure marks (PM1 and PM2) and values of ratios by weight of gelatin:silver (expressed as the equivalent amount of silver nitrate), called GESI and silica:silver (expressed in the same way), called SISI are summarized for the emulsion coated with different amounts of gelatin per m$^2$ and with varying amounts of silica particles.

Pressure marks PM1 are generated in the automatical processing unit when the film is wet and comes into contact with the rollers (see also evaluation of pressure marks in GB 1,486,603). Figures from "6" to "1" are indicative for materials evaluated as being "very bad" to "very good" for this type of pressure marks.

Pressure marks PM2 are generated prior to processing, thus in the dry state, e.g. during manufacturing, especially during the confection step. The sensitivity of the material for this type of pressure is simulated with a pressure test (see also EP-A 528 476) wherein pressure is applied upon the exposed material with different small wheels, each of them having a different weight and leaving differently marked rails upon the step wedge obtained after processing in a hand processor (to avoid PM1 marks, generated with contact at the rollers as mentioned hereinbefore). Again figures from "6" to "1" are indicative for materials evaluated as being "very bad" to "very good" for this type of pressure marks.

Moreover the time T when silica sol was added to the silver halide crystals is indicated: NO (if only gelatin was present), PREC (in the precipitation stage) and COAT (in the coating stage).

The sensitivity S was determined at a density of 1 above fog and support density; the gradation G between densities 1.8 and 2.4 above fog F and support density.

As the amount of light needed to reach a density of 1.00 above fog and support density is lower for the more light-sensitive materials the sensitivity is higher for lower values. Expressed as in Table II in 100 times log exposure this means that every decrease with a value of 30 is indicative for a material with a sensitivity that is twice as high.

Figures given for F, S and G have been multiplied by 100 in Table II.

Values of F(fog), S(sensitivity) and G(gradation) are represented by values multiplied by 1000 for F and 100 for S and G respectively.

TABLE II

| Exp. | P1 | | | P2 | | | | | | | |
|---|---|---|---|---|---|---|---|---|---|---|---|
| No | F | S | G | F | S | G | PM1 | PM2 | GESI | SISI | T |
| 1* | 21 | 193 | 411 | 16 | 201 | 366 | 6 | 3 | 0.4 | 0 | NO |
| 2* | 22 | 193 | 401 | 17 | 200 | 352 | 6 | 3 | 0.4 | 0 | NO |
| 3 | 19 | 207 | 371 | 12 | 214 | 333 | 2 | 2 | 0.3 | 0.1 | PREC |
| 4 | 17 | 206 | 374 | 12 | 214 | 339 | 2 | 2 | 0.3 | 0.1 | PREC |
| 5 | 16 | 207 | 359 | 12 | 214 | 324 | 2 | 1 | 0.3 | 0.1 | PREC |
| 6 | 18 | 207 | 359 | 12 | 214 | 332 | 2 | 1 | 0.3 | 0.1 | PREC |

TABLE II-continued

| Exp. | P1 | | | P2 | | | | | | | |
|---|---|---|---|---|---|---|---|---|---|---|---|
| No | F | S | G | F | S | G | PM1 | PM2 | GESI | SISI | T |
| 7* | 21 | 202 | 457 | 16 | 212 | 406 | 6 | 2 | 0.3 | 0.1 | COAT |
| 8* | 24 | 204 | 436 | 20 | 212 | 396 | 5 | 2 | 0.3 | 0.1 | COAT |

*comparative emulsion: no silica used during precipitation

From Table II it can be concluded that silver halide emulsions, precipitated in silica sol in the presence of an onium compound are superior versus silver halide emulsions having the same crystal size but precipitated in gelatin (see exp. No 1 and 2, where no silica is present in the coated layer): fog, sensitivity and pressure marks are outstanding in the various processing conditions P1 and P2. Even the presence of silica in the coated layer by addition before coating to attain the same silica:silver nitrate and gelatin-:silver nitrate ratio has no positive influence on the three above mentioned parameters. This again is an illustration for the crucial role of silica used as a protective colloid for silver halide crystals and the method according to this invention by which such crystals are prepared.

Example 4

The emulsion was precipitated just as in example 1, except for the presence of variable amounts in ml per 50 g of silver nitrate of 15% silica sol 'Kieselsol 500' (trademarked product of Bayer AG), and of the 5% co-stabilizing phosphonium compound (amt. COSTAB and amt. SILICA in Table III represent the amounts in g of co-stabilizer and silica sol per 50 g of silver nitrate). Further treatment was quite analogously as in Example 3 and the corresponding results are summarized in Table III. The symbols used have the same meaning as in Table III. Moreover the values of the ratio by weight of gelatin to silver halide, expressed as the equivalent amount of silver nitrate (called GESI) and of the ratio by weight of silica to silver halide, expressed as the equivalent amount of silver nitrate (called SISI) and of the mean crystal diameter of the cubic grains (DIAM) expressed in μm are also summarized. PM1 and PM2 are indicative for the pressure marks as set forth in Example 3 hereinbefore.

As a comparative emulsion with the same halide composition the silver halide crystals were prepared by a conventional double jet method quite analogously as described in Example 3.

Again values of F,S and G have been multiplied by 1000 for F and by 100 for S and G in Table III.

TABLE III

| Exp. No | F | S | G | amt. (g) COSTAB | amt. (g) SILICA | DIAM (μm) | GESI | SISI | PM 1 | PM 2 |
|---|---|---|---|---|---|---|---|---|---|---|
| 1* | 24 | 191 | 395 | 0 | 0 | 0.63 | 0.4 | 0 | 5 | 3 |
| 2 | 12 | 212 | 316 | 0.26 | 4.86 | 0.54 | 0.3 | 0.1 | 1 | 1 |
| 3 | 18 | 194 | 398 | 0.26 | 4.86 | 0.72 | 0.3 | 0.1 | 1 | 1 |

*comparative emulsion: no silica used during precipitation

From Table III it can be concluded that silver halide emulsions, precipitated in silica sol in the presence of an onium compound superior concerning pressure phenomena.

Example 5

Preparation of the comparative emulsion A

A gelatino silver iodobromide X-ray emulsion comprising 99 mole % of silver bromide and 1 mole % of silver iodide was prepared in the following way. An aqueous solution containing 3 grams of ammonia was added to the reaction vessel containing 1550 ml of a 3% by weight aqueous solution of gelatin at 45° C. Into said reaction vessel a solution of 2000 ml of an aqueous 1.5 molar solution of potassium bromide and a solution of 2000 ml of an aqueous 1.5 molar solution of silver nitrate were introduced at constant rate of 86 ml/min under vigorously stirring conditions. During precipitation the pAg value was adjusted to and maintained at a value corresponding to an E.M.F. of +20 mV with reference to a silver/saturated calomel electrode. In this way homogeneous and regular silver halide grains having a crystal diameter of 0.54 μm were obtained.

At the end of the precipitation step, the emulsion was coagulated by adding polystyrene sulphonic acid acting as a flocculating agent after adjustment of the pH value of the emulsion in the reaction vessel to 3.5 with sulphuric acid. After rapid sedimentation of said silver halide emulsion the supernatant liquid was decanted. To remove the water-soluble salts from said flocculate demineralized water of 11° C. was added under controlled stirring conditions followed by a further sedimentation and decantation. This washing procedure was repeated until the emulsion was sufficiently desalted. Thereafter the coagulum was redispersed at 45° C. in water after the addition of a sufficient amount of gelatin to obtain a ratio of gelatin to silver halide expressed as the equivalent amount of silver nitrate of 0.4. The pH-value was adjusted to 6.5 and pAg to a value of +70 mV as referred to the silver/saturated calomel electrode.

Preparation of the inventive emulsion B

The same emulsion as in example 4, see exp. No. 2 in Table III was taken as the emulsion according to this invention.

Chemical sensitization of emulsions A and B

Chemical sensitization of said emulsion was performed by the addition of a sulphur and gold sensitizer and digestion at 50° C. to the point where the highest sensitivity was reached for a still acceptable fog level.

Coating of emulsions A and B

Emulsions A (comparative) and B (invention) were coated at both sides of a blue polyethylene terephtalate support having a thickness of 175 μm. At both sides silver halide emulsion crystals were coated onto the support in amounts of 14.00 g, expressed as silver nitrate, per square meter. The amount of gelatin was 5.6 g (comparative) and 4.2 g (invention) per sq.m. Before coating stabilizers as 5-methyl-7-hydroxy-5-triazolo-[1,5-a]-pyrimidin and 1-phenyl-5-mercaptotetrazol were added to the emulsion. Both emulsion layers were covered with a protective layer of 1.4 grams of gelatin per square meter for both films and hardened with di-(vinyl-sulphonyl)-methane.

The said coated and dried films were exposed according to ISO 7004 with a 235 kV radiation source with a copper filter of 8 mm thickness.

The exposed radiographic films were developed, fixed, rinsed and dried in an automatic machine processing cycle of 8 minutes. The film was run in a Structurix NDT-1 machine marketed by Agfa-Gevaert and developed at 28° C. in the commercially available Agfa-Gevaert NDT-developer G135 whereupon it was fixed using Agfa-Gevaerts commercial G335 fixer.

Sensitometric results after exposure and processing according to the procedures described hereinbefore are listed in Table IV. The values given for the sensitivity S in Table IV are relative speed values: the speed of the film with the comparative emulsion was given a value of 100. Fog F includes the density of the blue support. Contrast G is the average gradient of the segment of the curve linking two points between densities 1.5 and 3.5. Other parameters have the same meaning as in the previous examples.

TABLE IV

| Exp. No | F | S | G | amt. (g) COSTAB | amt. (g) SILICA | DIAM (μm) | GESI | SISI | PM2 |
|---|---|---|---|---|---|---|---|---|---|
| 1* | 171 | 100 | 555 | 0 | 0 | 0.54 | 0.4 | 0 | 2 |
| 2 | 162 | 95 | 537 | 0.26 | 4.86 | 0.54 | 0.3 | 0.1 | 1 |

As can be seen from Table IV, the film comprising the emulsion according to this invention provides a better sensitivity for a lower fog and a better resistance to pressure phenomena in the dry state.

Summarized it is important to note that a high colloidal stability can be obtained for emulsions prepared in circumstances wherein the co-stabilizing onium compound is present in a sufficiently high concentration depending upon the size of the silica particles used and upon the ratio by weight of silica to silver halide so as to stabilize the silica-"network". As a result even after 24 hours there is no sedimentation observed of the silver halide crystals that are precipitated in the protective silica colloid.

We claim:

1. Method to prepare a light-sensitive regular silver bromide or silver bromoiodide emulsion comprising the following steps:

precipitating silver bromide or silver bromoiodide by addition of an aqueous solution of silver nitrate and halide salt(s) through a double-jet or triple-jet technique in colloidal silica having a particle size from 0.003 μm to 0.30 μm as a protective colloid in the presence of an onium compound, excluding ammonium ($NH_4$+) compounds, and in the absence of any polymeric compound capable of forming hydrogen bridges with colloidal silica, said polymeric compound including gelatin or its derivatives but not including polythioether compounds, wherein a ratio by weight of said colloidal silica to said onium compound(s) between 3 and 30 is present, controlling nucleation and growth of the silver bromide and silver bromoiodide by means of variable flow rate(s) of the aqueous solutions of silver nitrate and halide salts and/or by means of constant pAg-values during the said nucleation and growth in order to determine the number of nuclei quantitatively during said nucleation and to avoid renucleation during said growth, desalting and redispersing the silver bromide or bromoiodide, chemically ripening the silver bromide or silver bromoiodide and adding colloidal silica in order to obtain a ratio by weight of the colloidal silica to the amount of silver bromide or silver bromoiodide, expressed as the equivalent amount of silver nitrate, to a value of at least 0.03 at every moment throughout precipitation.

2. Method according to claim 1, wherein during nucleation a grain growth modifier is present.

3. Method according to claim 1, wherein desalting of the emulsion is performed by ultrafiltration.

4. Method according to claim 1, wherein chemical ripening is performed before, during or after spectral sensitization.

5. Method according to claim 1, wherein the emulsion is made ready for coating by addition to the emulsion of an amount of hydrogen-bridge forming polymer and/or silica in such an amount that the ratio of hydrogen bridge-forming polymer to silver halide expressed as silver nitrate is comprised between 0.05 and 0.40 and the ratio of silica to silver halide expressed as silver nitrate is comprised between 0.03 and 0.30.

6. Method according to claim 5, wherein the ratio of silica to silver bromide or silver bromoiodide expressed as silver nitrate is comprised between 0.05 and 0.15.

7. Method according to claim 5, wherein the said silver bromide or silver bromoiodide emulsion is made ready for coating by addition to the emulsion of an amount of hydrogen-bridge forming polymer so that a weight ratio of hydrogen-bridge forming polymer to silver bromide or bromoiodide, expressed as equivalent amount of silver nitrate, between 0.15 and 0.30 is obtained.

8. Method according to claim 5, wherein the said silver bromide or silver bromoiodide emulsion is made ready for coating by adding silica in such an amount that a weight ratio of silica to silver bromide or bromoiodide, expressed as equivalent amount of silver nitrate, between 0.02 and 1.0 is obtained.

9. A silver halide light-sensitive photographic material having a support and, provided thereon, at least one hydrophilic colloid layer including at least one light-sensitive silver halide emulsion layer characterised in that said light-sensitive silver halide emulsion layer is coated from at least one regular silver bromide or silver bromoiodide emulsion, prepared by the method according to claim 1.

* * * * *